US006394265B1

(12) United States Patent
Tsao

(10) Patent No.: US 6,394,265 B1
(45) Date of Patent: May 28, 2002

(54) FOLDABLE CARRIER MEANS FOR SIMULTANEOUSLY CARRYING CENTRAL CONTAINER AND SIDE CONTAINER

(76) Inventor: Chung-Piao Tsao, 4F, No. 22, Lane 346, Kuang-Fu S, Road, Taipei (TW)

( * ) Notice: Subject to any disclaimer, the term of this patent is extended or adjusted under 35 U.S.C. 154(b) by 31 days.

(21) Appl. No.: 09/664,925

(22) Filed: Sep. 16, 2000

(51) Int. Cl.[7] ..... B65D 77/00

(52) U.S. Cl. ..... 206/217; 206/549; 206/427; 229/904

(58) Field of Search ..... 206/146, 217, 206/427, 549; 220/23.4, 23.8, 482; 229/400, 904

(56) References Cited

U.S. PATENT DOCUMENTS 3,640,380 A * 2/1972 Huffman
4,183,444 A * 1/1980 English et al. ..... 220/23.4
4,491,220 A * 1/1985 Daviss ..... 206/217
5,267,644 A * 12/1993 Tsao ..... 206/151
5,850,911 A * 12/1998 Pakzad ..... 206/217
6,183,027 B1 * 2/2001 Tsao ..... 206/549
6,230,969 B1 * 5/2001 Spransy ..... 229/400
2001/0030227 A1 * 10/2001 Fear et al. ..... 229/400

* cited by examiner

*Primary Examiner*—David T. Fidei

(57) ABSTRACT

A foldable carrier includes a main carrier having at least a bottom hole formed in a base plate for engaging and holding a central container, and having at least a lug formed on a side wall of the carrier, and at least a side container having a slot formed therein to be engageable with the lug of the main carrier for hanging the side container on the side wall of the main carrier, thereby simultaneously conveniently carrying a central container which may be filled with beverage and carrying a side container which may be filled with popcorn by a user's single hand.

9 Claims, 6 Drawing Sheets

FOLDABLE CARRIER MEANS FOR SIMULTANEOUSLY CARRYING CENTRAL CONTAINER AND SIDE CONTAINER

BACKGROUND OF THE INVENTION

U.S. Pat. No. 5,267,644 issued to the same inventor of this application disclosed a tuckable carrier having a plurality of container holes formed in a central base plate portion for holding containers such as beverage containers or cups in the holes for portable use. For example, the containers may be filled with cola or other soft drinks to be carried by a user's one hand. If he or she wants to further carry a cup of popcorn, his (or her) two hands are required to simultaneously carry the beverage containers, and the popcorn cup, causing carrying inconvenience or even accidental dropping.

The present inventor has invented the foldable carrier means for simultaneously carrying beverage and popcorn safely and conveniently.

SUMMARY OF THE INVENTION

The object of the present invention is to provide a foldable carrier including a main carrier having at least a bottom hole formed in a base plate for engaging and holding a central container, and having at least a lug formed on a side wall of the carrier, and at least a side container having a slot formed therein to be engageable with the lug of the main carrier for hanging the side container on the side wall of the main carrier, thereby simultaneously conveniently carrying a central container which may be filled with beverage or the like and carrying a side container which may be filled with popcorn or the like only by a user's single hand.

DETAILED DESCRIPTION

Figure 1:
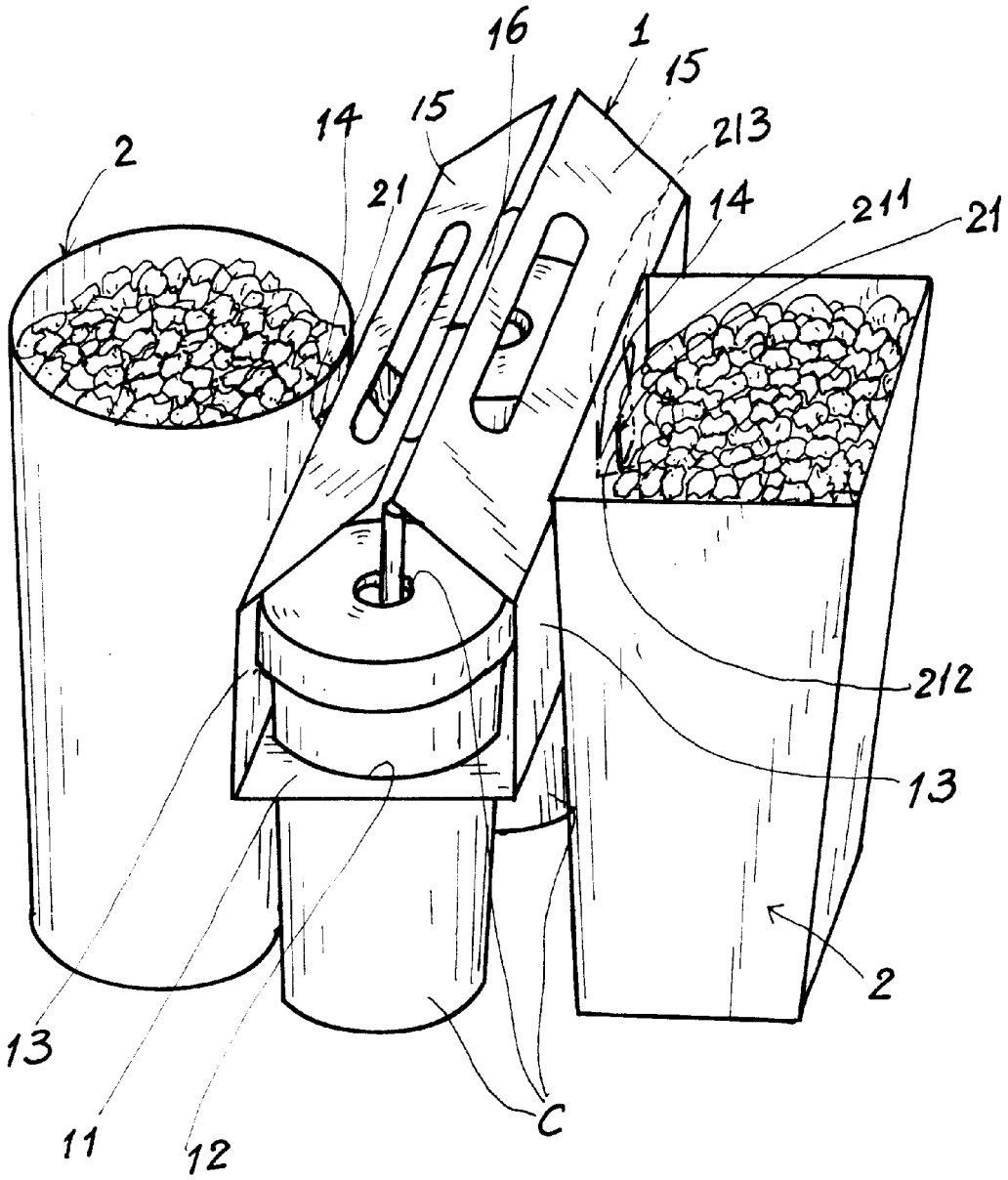
FIG. 1 is a perspective view of the present invention.
Figure 2:
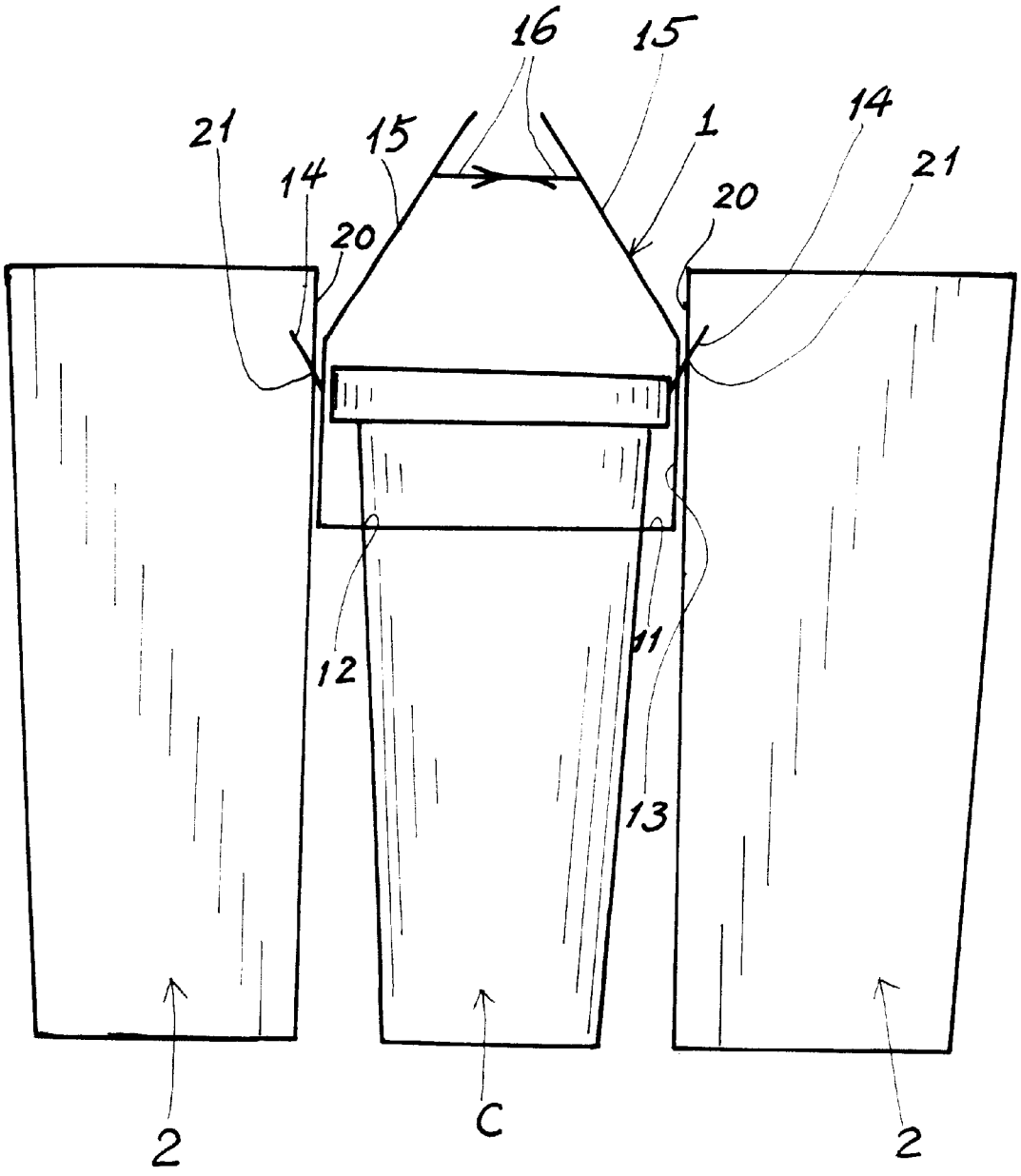
FIG. 2 is a front view of the present invention.
Figure 3:
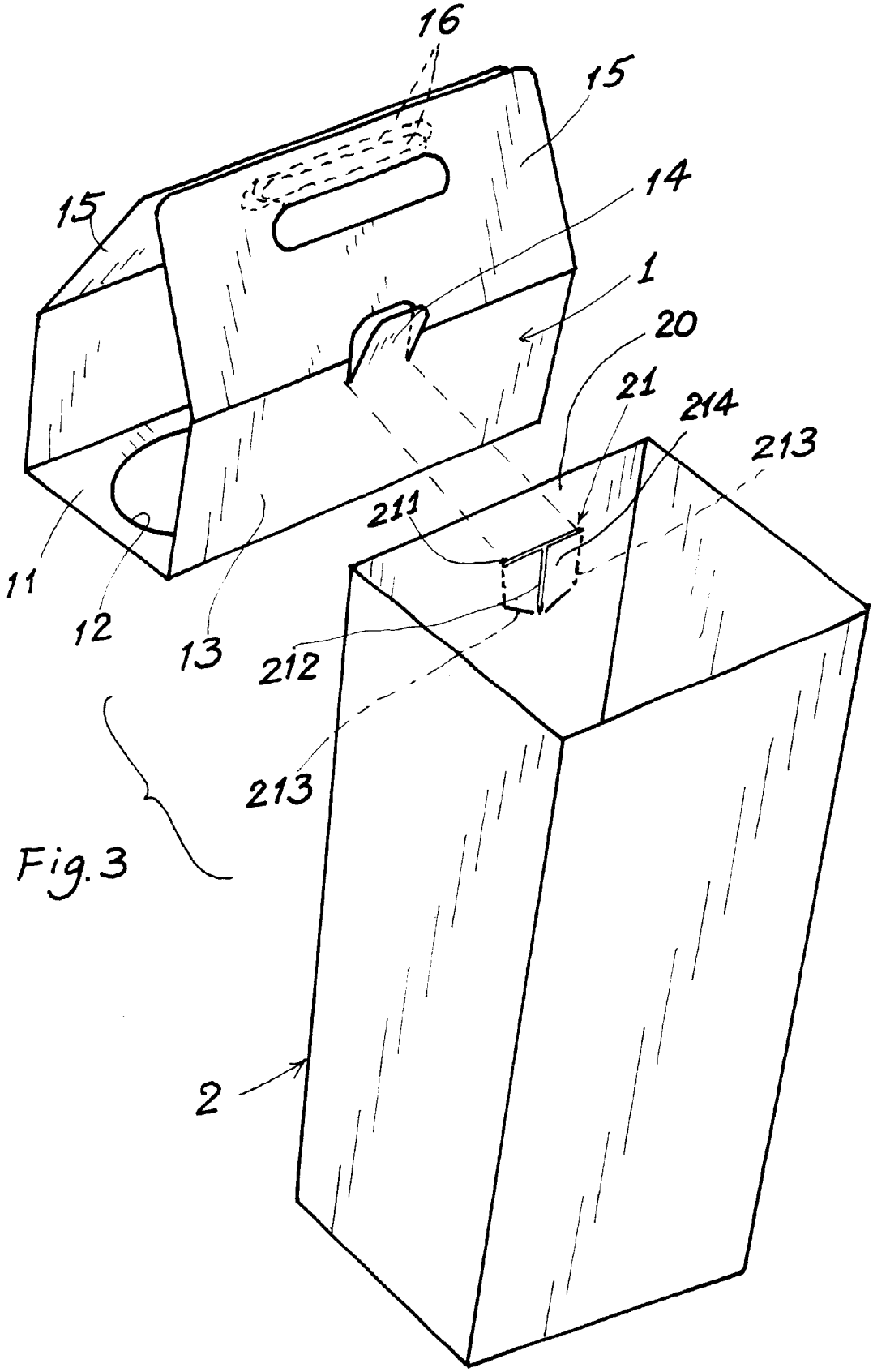
FIG. 3 shows a main carrier and a side container of the present invention.

As shown in FIGS. 1~3, the present invention comprises: a main carrier 1 having at least a lug 14 formed on a side wall 13; and a side container 2 having a slot 21 formed in the side container and engageable with the lug 14 of the main carrier 1 so as to hang the side container 2 on the main carrier 1.

The main carrier 1 includes: a base plate 11 having a plurality of bottom holes 12 formed in the base plate 11 for respectively engaging and holding a central container C in each bottom hole 12, two side walls 13 respectively formed on opposite ends of the base plate 11 and foldable to be parallelly perpendicular to the base plate 11, and two handle members 15 each protruding upwardly from each side wall 13 and the two handle members 15 foldably interlockable to be a "handle" for carrying purpose.

Figure 4:
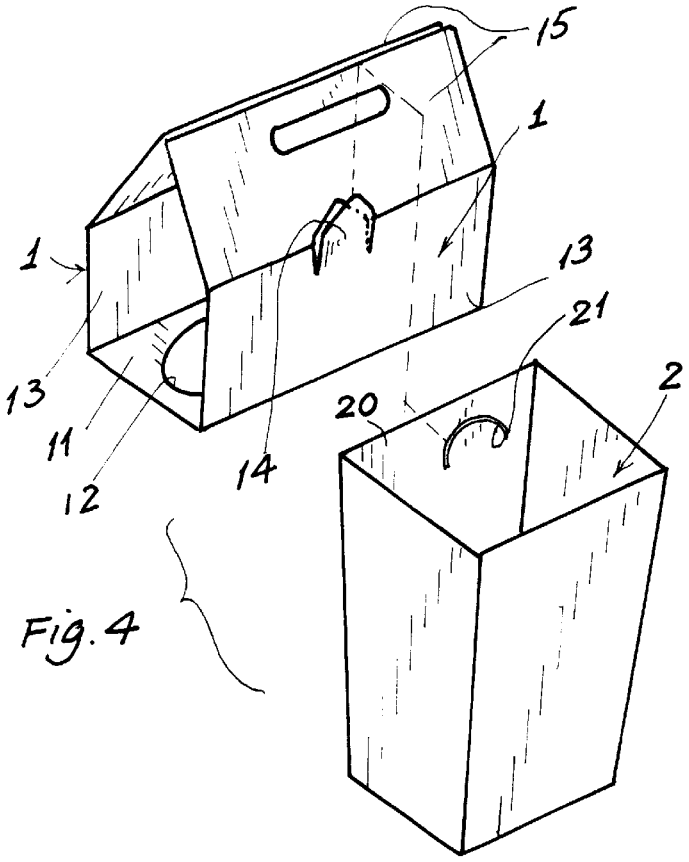
FIG. 4 shows another preferred embodiment of the present invention.
Figure 5:
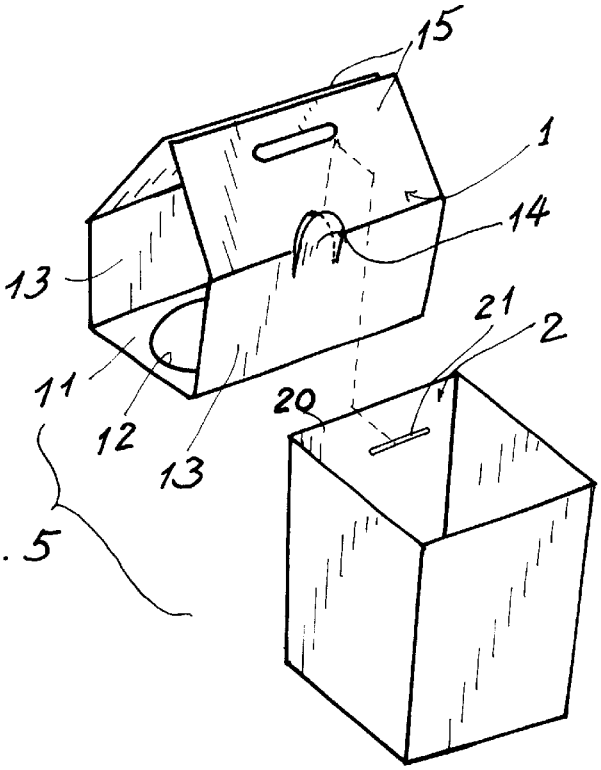
FIG. 5 shows still another preferred embodiment of the present invention.

The lug 14 may be directly cut out from the side wall 13 generally protruding upwardly outwardly and may be formed as an arcuate shape (FIG. 5), an angular shape (FIG. 4), a rectangular shape (FIG. 3) or other suitable shapes, not limited in the present invention.

The slot 21 may also be directly cut out from a side wall 20 of the side container 2. The slot 21 may be formed as a T shape (FIG. 3), an arcuate shape (FIG. 4), a linear slot (FIG. 5), or any other suitable shapes, not limited in the present invention.

The central container C may be a beverage container or cup filled with cola, soft drink or any other foods or materials, while the side container 2 may be filled with popcorn or any other foods or materials.

Figure 9:
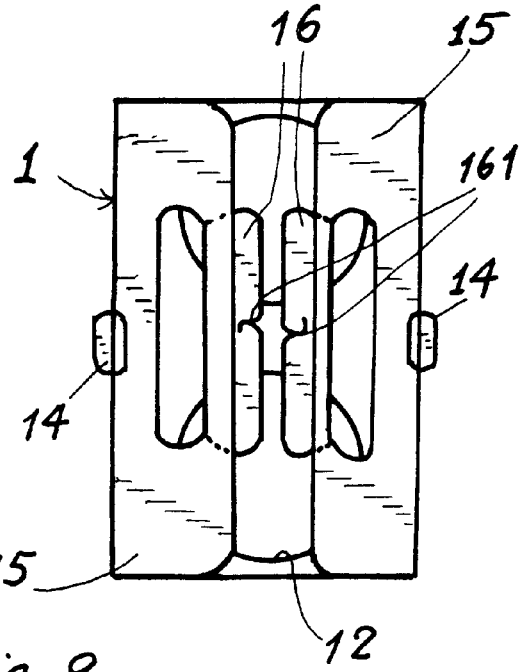
FIG. 9 is a top view of the present invention when two handle members are not yet interlocked.
Figure 10:
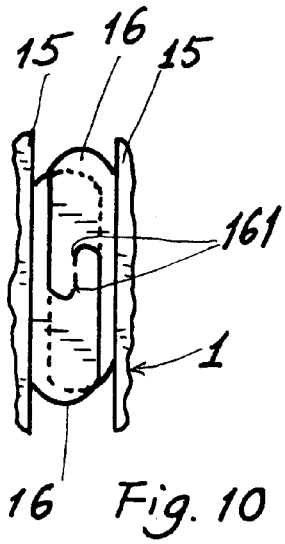
FIG. 10 is a top view showing the two handle members already interlocked.

As shown in FIGS. 9, 10, each handle member 15 is formed with an interlockable flap 16 having a L-shaped (or other shapes) slot 161 cut in each flap 16 so that two interlockable flaps 16 may be interlocked for coupling the two handle members 15 for carrying the present invention.

The slot 21 as shown in FIG. 3 includes: a horizontal slit 211, a vertical slit 212 perpendicular to the horizontal slit 211, and a pair of folding lines 213 each connecting a bottom end of the vertical slit 212 and a side end of the horizontal slit 211.

The folding line 213 may be a perforated line or a linear line formed with a shallow recess along the line for helping folding of each tab 214 as defined among the horizontal slit 211, the vertical slit 212 and the folding line 213. The folding line 213 may be intermittently or continuously formed on a side wall of the side container 2 between the horizontal and vertical slits 211, 212.

Figure 6:
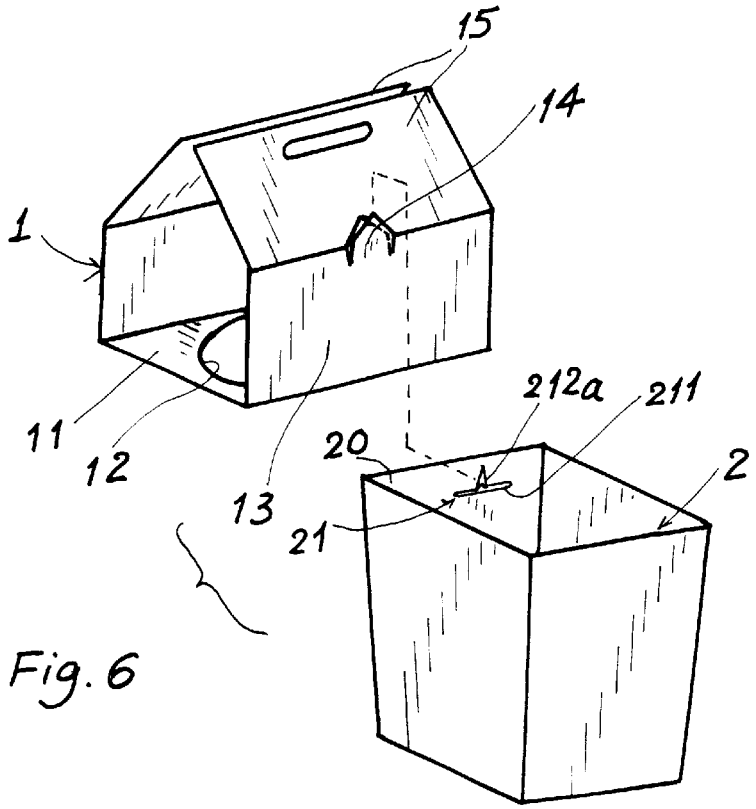
FIG. 6 shows further preferred embodiment of the present invention.

As shown in FIG. 6, the slot 21 includes: a horizontal slit 211 ad a convex portion 212*a* slightly protruding outwardly from the side wall 20 of the side container 2 and perpendicular to the horizontal slit 211, thereby forming a slightly enlarged "guiding slot " for slidably inserting the lug 14 into the slot 21 for a smooth engagement of the lug 14 with the slot 21 for facilitating the coupling or hanging of the side container 2 to the main carrier 1.

Figure 7:
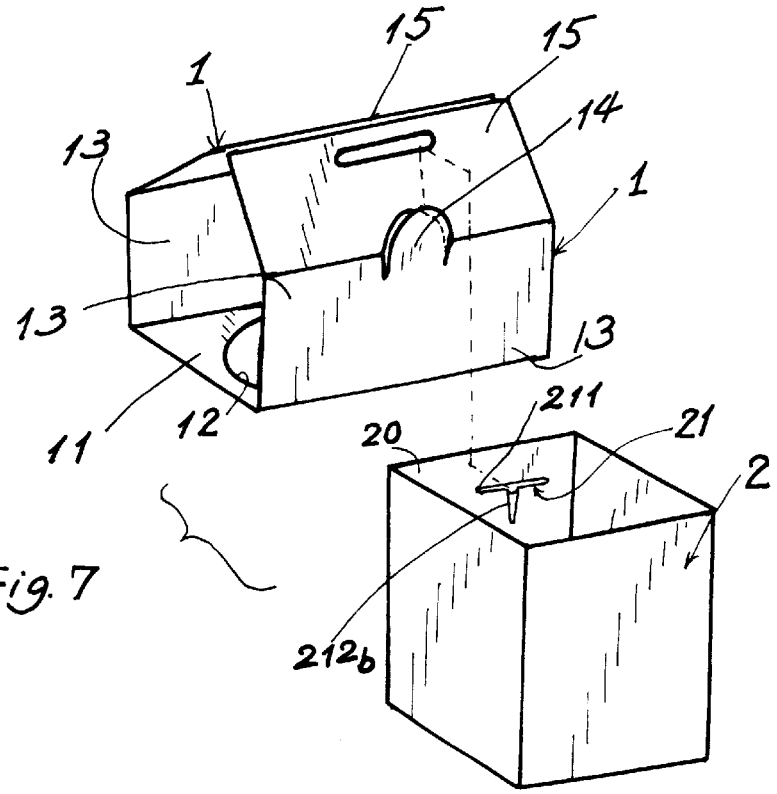
FIG. 7 shows still further preferred embodiment of the present invention.

As shown in FIG. 7, the slot 21 includes: a horizontal slit 211 and a concave portion 212b slightly recessed inwardly from the side wall 20 of the side container 2 and perpendicular to the horizontal slit 211, also forming a "guiding slot" for easily engaging the lug 14 with the slot 21.

The present invention may "hang" two side containers 2, 2 on a left and a right side of the main carrier 1 as shown in FIGS. 1~3.

Figure 8:
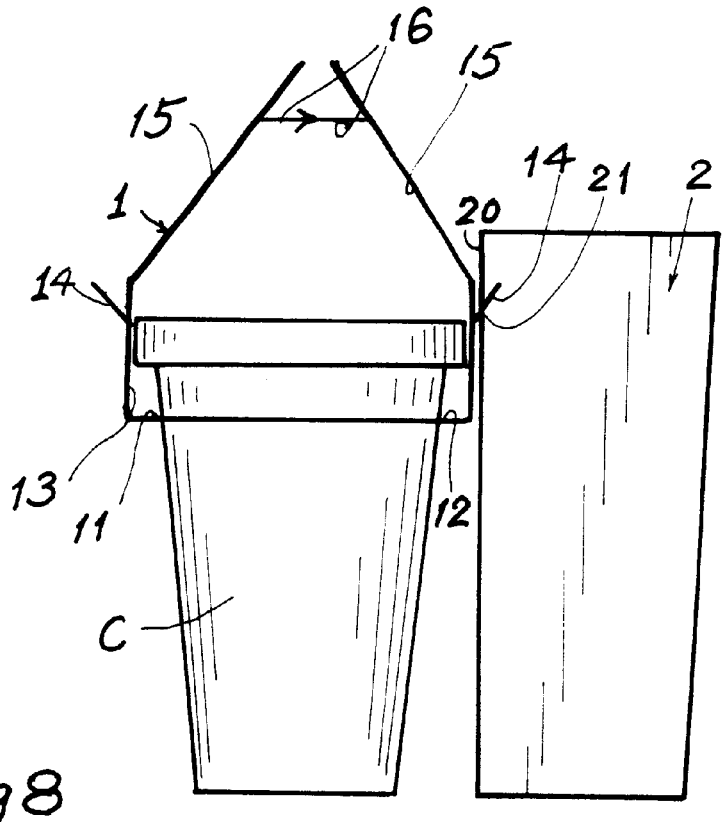
FIG. 8 is an illustration showing a single side container hung on the main carrier of the present invention.

Or, a single side container 2 may be hung on one side of the main carrier 1 as shown in FIG. 8, not limited in the present invention.

The present invention may be modified without departing from the spirit and scope of the present invention. For instance, the side container 2 may not be cut with the slot 21 as aforementioned and may be adhered or formed with a loop, a collar or a ring member (not shown) to be coupled and fastened on the lug 14 of the main carrier 1 to couple the side container 2 to the main carrier 1.

The main carrier 1 may also be formed with a slot (not shown) in a side wall 13 thereof to be engaged with a hook member formed or adhered to a side wall of the side container 2, thereby coupling the side container 2 to the main carrier 1.

The present invention provides a carrier or carrying device with simple construction for conveniently simultaneously carrying a central container C (such as for cola drink) and a side container 2 (such as for popcorn) just by a user's single hand who carries the handle members 15, 15 as interlocked, thereby being superior to the prior art or conventional carrying devices.

I claim:

1. A foldable carrier comprising:

a main carrier for carrying at least a central container thereon, having at least a lug formed on and protruding upwardly outwardly from said main carrier; and said main carrier including: a base plate having a plurality of bottom holes formed in the base plate for respectively engaging and holding each said central container in each said bottom hole, two side walls respectively formed on opposite ends of the base plate and foldable to be parallelly perpendicular to the base plate, and two handle members each protruding upwardly from each said side wall and the two said handle members foldably interlockable to be a handle for carrying said main carrier; and at least a side container having a slot formed therein to be engageable with said lug of said main carrier to hang said side container on said main carrier, thereby simultaneously carrying the central container and said side container just by carrying said main carrier.

2. A foldable carrier according to claim 1, wherein said lug is directly cut out from one said side wall of said main carrier.

3. A foldable carrier according to claim 1, where said lug has an upper portion thereof formed as an arcuate shape, an angular shape, and a rectangular shape.

4. A foldable carrier according to claim 1, where said slot is directly cut out from one said side wall of the side container.

5. A foldable carrier according to claim 1, where said slot includes: a horizontal slit, a vertical slit perpendicular to the horizontal slit, and a pair of folding lines each connecting a bottom end of the vertical slit and a side end of the horizontal slit.

6. A foldable carrier according to claim 5, where said folding line includes a perforated line and a linear line formed with a shallow recess along the line for helping folding of a tab as defined among the horizontal slit, the vertical slit and the folding line when engaging said lug in said slot.

7. A foldable carrier according to claim 1, where said slot includes: a horizontal slit and a convex portion slightly protruding outwardly from one said side wall of the side container and perpendicular to the horizontal slit for slidably inserting the lug into the slot for a smooth engagement of the lug with the slot for coupling the side container to the main carrier.

8. A foldable carrier according to claim 1, where said slot includes: a horizontal slit and a concave portion slightly recessed inwardly from one said side wall of the side container and perpendicular to the horizontal slit for engaging the lug with the slot.

9. A foldable carrier according to claim 1, where said central container is provided for filling beverage or drink therein; and said side container provided for filling popcorn therein.

* * * * *